US005139255A

United States Patent [19]

Sollami

[11] Patent Number: 5,139,255

[45] Date of Patent: Aug. 18, 1992

[54] EXERCISE MACHINE

[76] Inventor: Phillip A. Sollami, 1300 E. Pine, Herrin, Ill. 62948

[21] Appl. No.: 579,679

[22] Filed: Sep. 10, 1990

[51] Int. Cl.[5] ..... A63B 21/00

[52] U.S. Cl. ..... 482/58; 482/62

[58] Field of Search ..... 272/73, 130, 71, 72, 272/96, 70

[56] References Cited

U.S. PATENT DOCUMENTS 4,563,001 1/1986 Terauds ..... 272/130

4,830,362 5/1989 Bull .

*Primary Examiner*—Stephen R. Crow

*Attorney, Agent, or Firm*—Edmond T. Patnaude; Jim N. Videbeck; Robert L. Marsh

[57] ABSTRACT

Exercise machines include a hydraulic torque resistance device having a rotor which is connected to a pair of vertically movable pedals. In one disclosed embodiment of the invention a vertically adjustable seat is provided in conjunction with a pair of handle bars respectively connected to the pedals in a manner such that downward movement of one of the pedals is accompanied by rearward movement of the associated handle bar. Simultaneously with the downward movement of one pedal the other pedal moves up and the other handle bar which is associated therewith the other pedal moves in the forward direction.

4 Claims, 5 Drawing Sheets

EXERCISE MACHINE

The present invention relates in general to a new and improved machine for use in exercising one's legs, and it relates more particularly to a new and improved exercise machine wherein a pair of pedals are adapted to be moved up and down in substantially vertical directions, such movements being opposed by an adjustable hydraulic resistance device.

BACKGROUND OF THE INVENTION

Machines for exercising the legs have often incorporated rotationally movable crank and pedal assemblies of the type commonly found in bicycles. Indeed, such machines frequently include a pair of handle bars and a bicycle type seat or saddle. While rotary movement of the pedals is a very good exercise for bicyclists, that is not the usual movement of the human legs.

SUMMARY OF THE INVENTION

Briefly, there is provided in accordance with the present invention a new and improved exercise machine having a pair of pedals mounted for reciprocal, substantially vertical movement. The pedals are interconnected to one another and to a hydraulic resistance device such that when one pedal moves up the other pedal moves down. The effect on the person using the machine is similar to climbing stairs.

In one embodiment of the invention a pair of handle bars are respectively connected to the pedals and move back and forth toward and away from a saddle-like seat in synchronism with the up and down movement of the pedals.

In another embodiment of the invention the pedals are replaced by foot pads and the seat is replaced by a platform located rearwardly and below the lowermost positions of the foot pads. When using this version of the invention, the person using the machine steps up on one of the food pads with one foot and then steps on the other foot pad with the other foot. The resulting movement of the legs has been found to provide a particularly effective exercise.

An important feature of the exercise machines of the present invention is the use of hydraulic resistance devices which resist movement of the pedals and the handle bars equally in both directions. In one embodiment of the invention straps which extend over the tops of the exerciser's feet are provided so that his or her legs can be used to lift the pedals against the resistive force of the hydraulic force resistance device.

GENERAL DESCRIPTION OF THE DRAWINGS

Further objects and advantages and a better understanding of the present invention will be had by reference to the following detailed description taken in connection with the accompanying drawings wherein.

DETAILED DESCRIPTION OF A PREFERRED EMBODIMENT OF THE INVENTION

Figure 1:
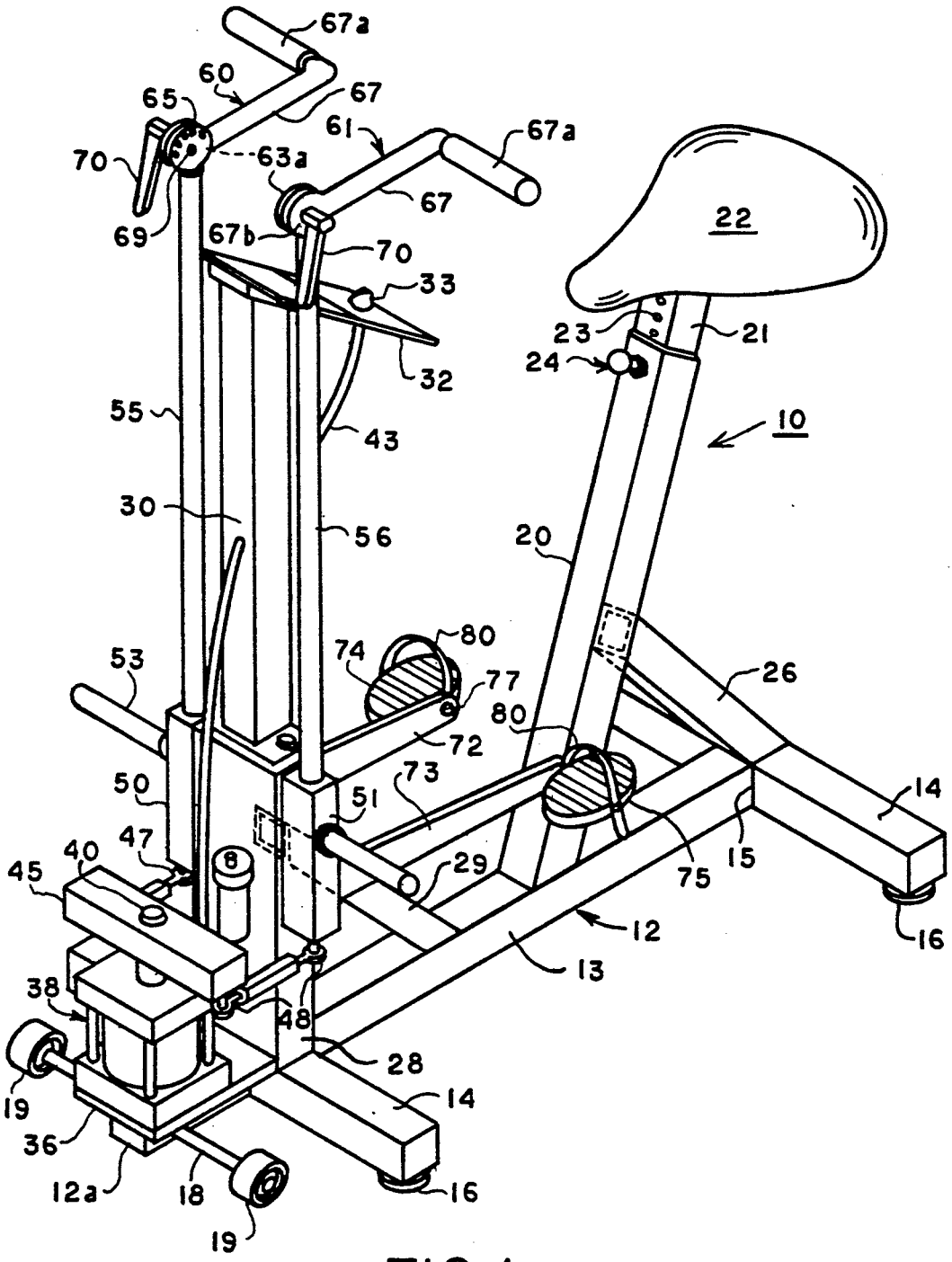
FIG. 1 is an isometric view of an exercise machine embodying the present invention.

Referring particularly to FIG. 1 there is shown an exercise machine 10 for use in exercising the upper and lower parts of the human body. The machine includes a base frame 12 which is made up of a rigid, horizontal tubular member 13 and a plurality of laterally extending horizontal cross members 14. The cross members 14 are affixed to the longitudinal member 13 by suitable means such as by weldments 15. Five foot members 16 are respectively mounted to the bottom sides of the members 13 and 14. The central longitudinal frame member 13 extends forwardly of the frontmost cross member 14. A shaft 18 extends through a suitable hole in the frame member 13 and is affixed thereto as by welding. A pair of wheels 19 which are respectively journaled on the opposite end portions of the shaft 18 are dimensioned such that the wheels are a short distance above a flat floor on which the five feet 16 rest. Preferably the feet 16 have an elastomeric friction surface on the bottom to prevent spurious movement of the machine along the floor on which the machine 10 rests.

A tubular member 20 is affixed at its bottom to the top side of the central frame member 13 as by welding and may be seen to extend upwardly and to the rear at an angle of about 70 degrees from the horizontal plane. The member 20 is square in cross-section and another tubular member 21 having an external cross-section complementary to the external cross-section of the member 20 is telescopically fitted therein for adjustable movement along the longitudinal axis of the member 20. A saddle type seat 22 is suitably affixed to the upper end of the member 21. A plurality of holes 23 are provided in the front side of the member 21, and a pin and knob assembly 24 is mounted at the top of the member 21 for axial movement in and out of a selected one of the holes 23 for adjusting and locking the seat at a selected height from the base 12. An angular bracket member 26, which is also tubular and square in cross-section, is welded at its ends to the base member 13 and to the upright member 20. The use of tubular frame members provides a high strength to weight ratio, which facilitates movement of the machine when desired.

In order to move the machine, a person simply lifts the machine off of the feet 16 by applying an upward force to the seat 22 which tilts the machine about the axis of the shaft 18. When thus tilted, most of the weight of the machine is supported by the wheels 19 whereby the machine can be readily rolled from one place to another.

Extending upwardly in a vertical direction from the base 12 is a tubular frame member 28. An additional brace member 29 of tubular construction is welded at its respective ends to the frame member 28 and to the base frame member 13 to maintain the upright frame member 28 in the vertical position. Extending upwardly from the top of the frame member 28 is a tubular support member 30 to the top of which is mounted a dial plate 32 carrying a rotatable torque adjusting knob assembly 33 as more fully described hereinafter.

Mounted on top of the forward horizontal frame portion 12*a* is a rigid plate 36. The plate is affixed to the frame by suitable means such as weldments (not shown). A rotary hydraulic torque resistance device 38 rests on and is secured to the plate 36. The torque resistance device may be of any suitable construction wherein rotation of a shaft 40 is resisted by a constant torque throughout its range of annular movement. A preferred hydraulic torque resistance device is described in my copending application Ser. No. 296,680 filed Jan. 13, 1989. In that device there is provided a rotor to which the shaft 40 is axially connected. As the shaft and rotor are rotated, hydraulic fluid is forced from one side of a stator to the other through a valve which provides an adjustable restriction in the hydraulic line between one side of the stator and the other. This adjustable valve is identified in FIGS. 2 and 3 at 42 but is not visible in FIG. 1. A control cable 43 extends from the valve 42 to the control knob assembly 33 to permit a person seated on the seat 22 to adjust the torque required to rotate the shaft 40.

Figure 2:
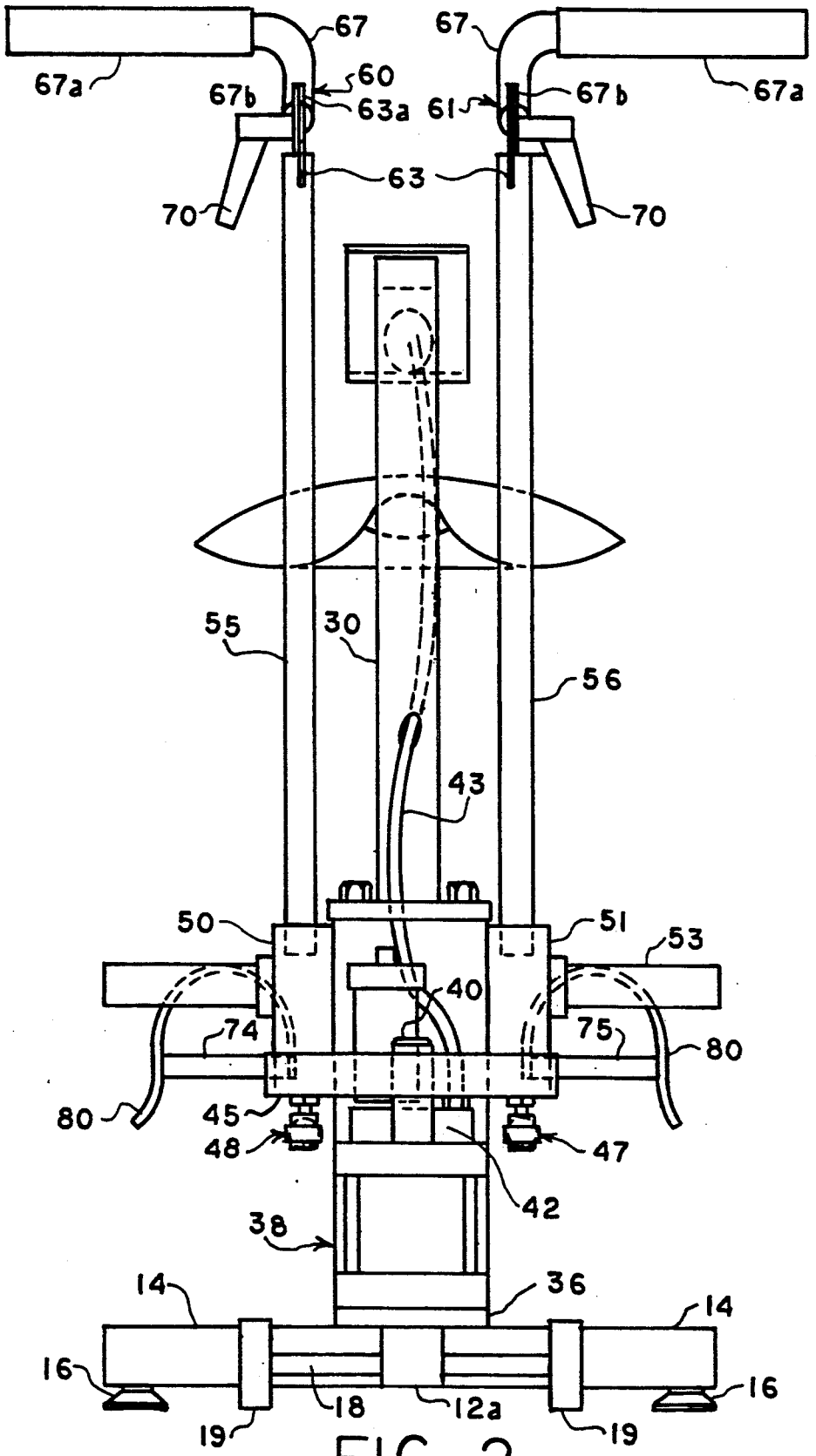
FIG. 2 is a front view of the exercise machine shown in FIG. 1.

As best shown in FIGS. 1 and 2 a cross arm 45 is affixed at the center thereof to the shaft 40 and is connected at its ends by a pair of special bearings 47 and 48 to a pair of pivot blocks 50 and 51. The pivot blocks 50 and 51 are rotatably supported on a shaft 53 which is affixed to and extends from the upright frame member 28. Extending upwardly from the tops of the pivot blocks 50 and 51 are a pair of handle bar support rods 55 and 56. The lower ends of the rods 55 and 56 are affixed to in the sides of the blocks 50 and 51.

Figure 3:
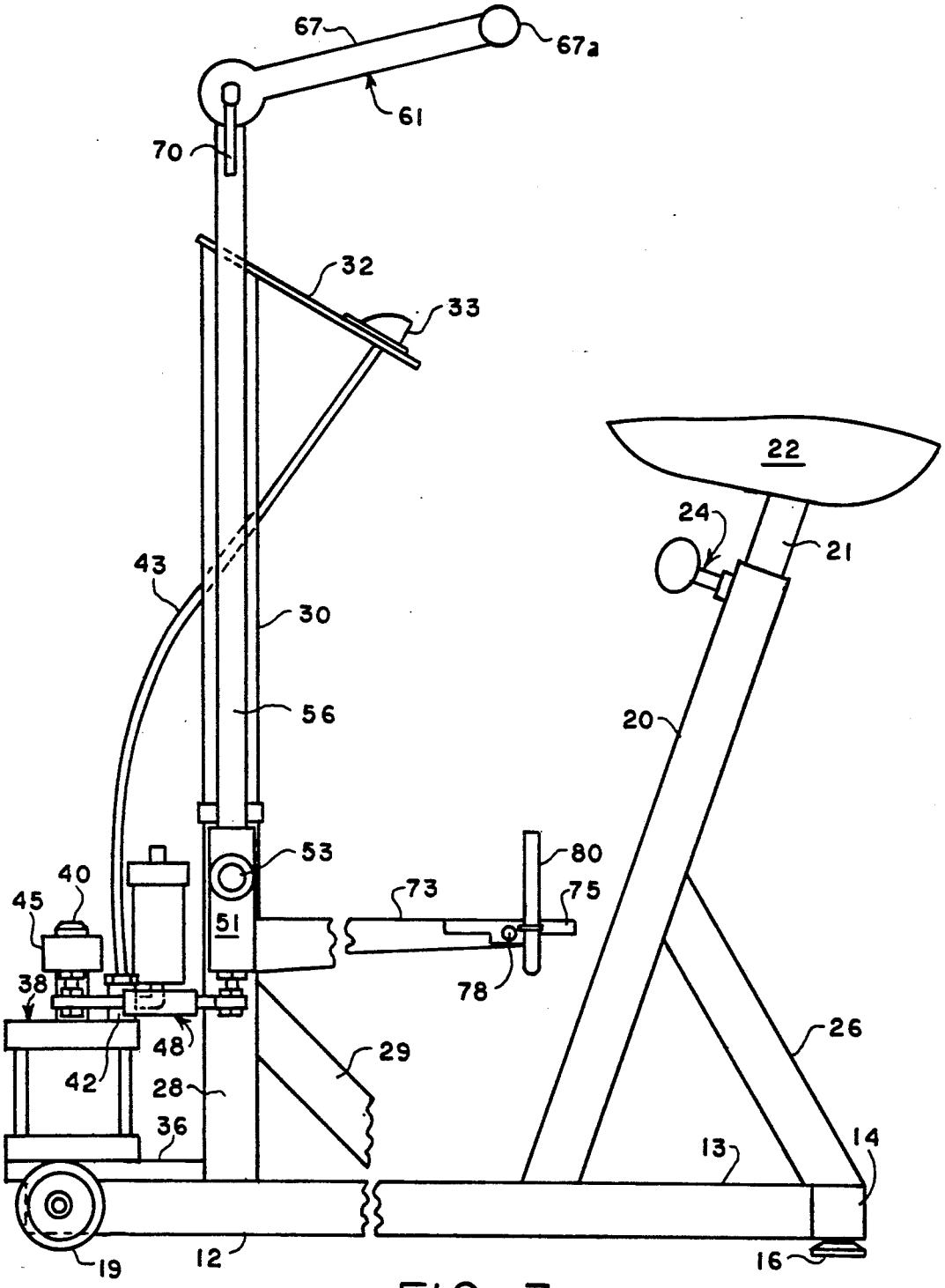
FIG. 3 is an elevational view taken from the right hand side of FIG. 2.

As can best be seen in FIGS. 1, 2 and 3, the handlebar assemblies are mirror images of one another and each includes an upstanding plate member 63 having a circular upper end portion **63*a* provided with a plurality of radially spaced holes 65. The handlebar assemblies also include handlebar members 67 which have an outwardly turned handle portion 67*a* at one end and a circular portion 67*b* at the other end. The circular end portions 67*b* complement the circular portions 63*a* of the plate 63. A shaft 69 extends from each plate 63 through a central opening in the corresponding circular portion 67*b*, and a pair of handles 70 are threadedly secured over the ends of the shafts 69 to lock the handlebars in adjusted angular positions relative to the support rods 55 and 56. In order to lock the handlebars in the adjusted positions a detent lug (not shown) may be provided on each of the circular portions 67*b* for reception in a selected one of the holes 65 in the plate portions 63*a*. Adjustment of the handlebars is accomplished by loosening of the handles 70, pulling the handlebar outwardly to release the lug from the holes 65 and then rotating each handlebar to the desired position where the lugs are aligned with selected ones of the holes 65. The handles 70 are then tightened on the shaft 69** to lock the handlebars in the adjusted positions.

A pair of pedal support arms 72 and 73 are affixed at the front ends thereof to the portions of the blocks 50 and 51 below the shaft 53. A pair of pedals 74 and 75 are respectively connected to the rear end portions of the support arms 72 and 73 by jack shafts (not shown) which extend outwardly from the support arms. A pair of straps 80 are respectively affixed to the pedals for disposition over the feet of the person using the machine.

OPERATION

When about to use the machine for the first time, a person will pull the seat adjusting knob forwardly to release the member 21 from the member 20, and he or she then adjusts the vertical position of the seat to that which is believed to be the most comfortable. The straps 80 can be adjusted to permit the users feet to fit comfortably on the pedals while still being relatively tight to permit the application of an upward force to the pedals 74 and 75 by the person sitting on the seat 22.

While sitting on the seat a person can exercise both the legs and the upper parts of the body by grasping the handlebars with the hands and placing the feet on the pedals under the straps 80. The pedals are then moved up and down using the leg muscles and the handlebars will simultaneously move back and forth in a front to rear direction. Unlike riding a bicycle the pedals do not move in a circle but move essentially up and down. Moreover, the force required to move the pedals up and down is constant throughout the entire range of pedal movement.

If it is desired to exercise only the upper part of the body, the user can allow his or her feet to simply rest on the pedals and use only the handlebars and only the legs are then used to pivot the blocks 50 and 51 and the crossarm 45. Also, rather than pushing down on the pedals, the user may only pull up on the straps 80 and thereby exercise another entirely different sets of leg muscles. Similarly, the handlebars can either be pushed forward only or pulled backward only. An important feature of the exercise machine 10 is the fact that irrespective of the direction of movement of the pedals or the handlebars the force required to pivot the crossbar 40 is constant throughout constant throughout its entire stroke. This is very different from the force required to rotate the wheel or wheels of a bicycle where the force varies greatly from a maximum to a minimum as the pedals rotate through 360 degrees.

An additional advantage of the machine 10 is the ability of the person seated on the seat 22 to adjust the force required to be applied to the pedals and to the handlebars to effect movement thereof. The force adjusting knob 33 is located at a readily accessible place for facile adjustment by a person seated on the seat 22.

Figure 4:
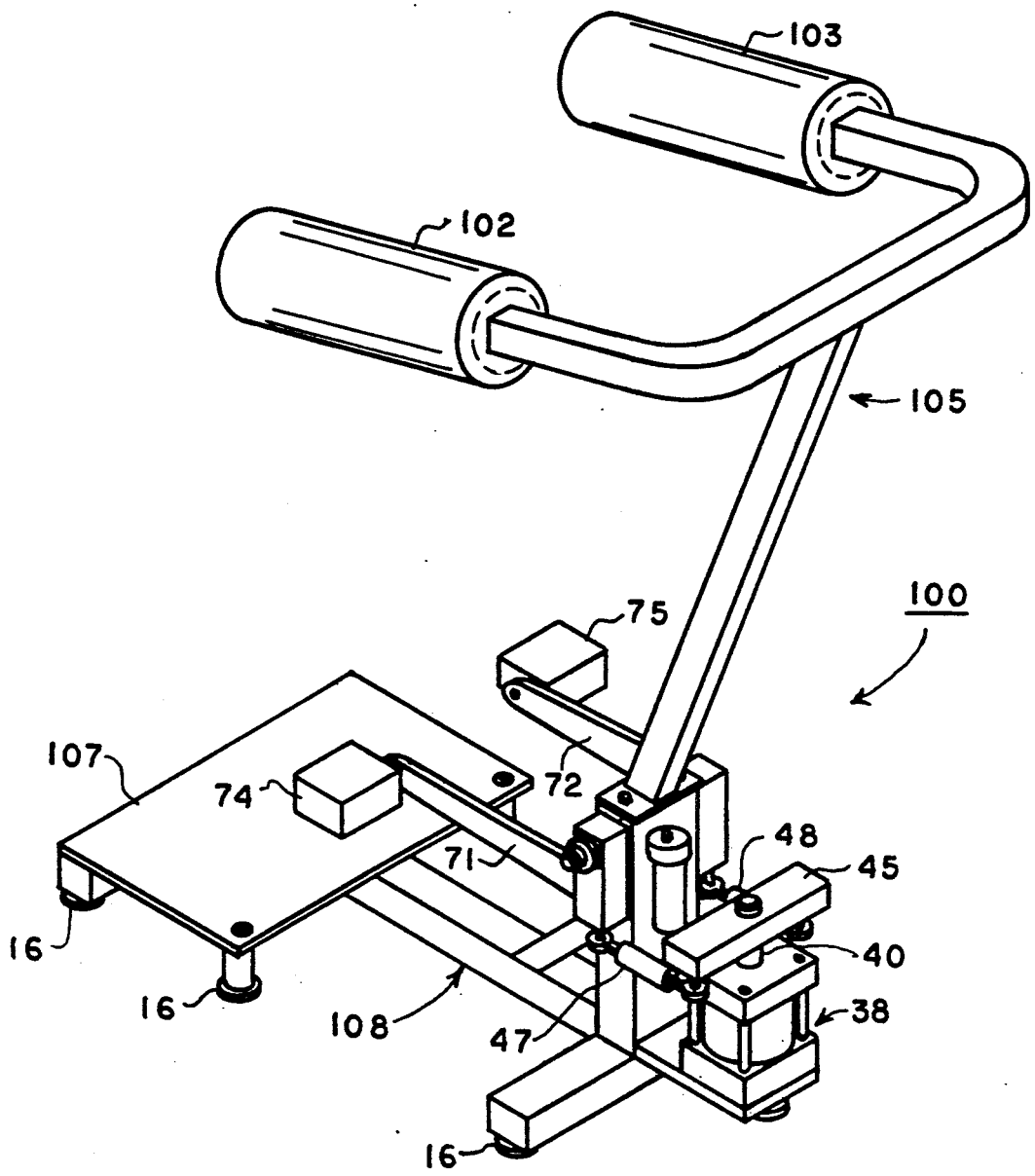
FIG. 4 is an isometric view of another exercise machine embodying the present invention.

Referring to FIG. 4, there is shown an exercise machine 100 for use in exercising the lower body parts only. In many respects it is identical to the machine 10, and like parts are identified by the same reference numerals. Like the machine 10 the machine 100 utilizes a rotary hydraulic torque resistance device 38 having a shaft 40 to which a cross arm 45 is affixed. Unlike the machine 10, the machine does not have movable handlebars which move simultaneously with the foot pads. Rather, the machine 100 incorporates a pair of fixedly disposed padded arm rests 102 and 103 which are positioned at a fixed elevated position by a yoke frame 105 which is mounted to the top of the vertical support member 28.

A platform 107 is affixed to the rear of the base frame 108 rearwardly and below the foot pads 74 and 75. The exercise performed on the machine 100 simulates walking up a flight of stairs. In use, the adjusting knob 33 is moved to the maximum resistance setting on the dial plate. A person stands on the platform 107 and first places one foot on one of the foot pads and then places the other foot on the other foot pad. The person then selects the amount of resistance desired for exercising by moving the adjusting knob 33 to the desired position. The person then shifts his or her weight to one foot which causes that food pad to move down and the other foot pad to move up. This cycle is repeated throughout the exercise. If desired, the arms and the upper body can be used to assist the lower parts in shifting the body weight from one pedal to the other.

Figure 5:
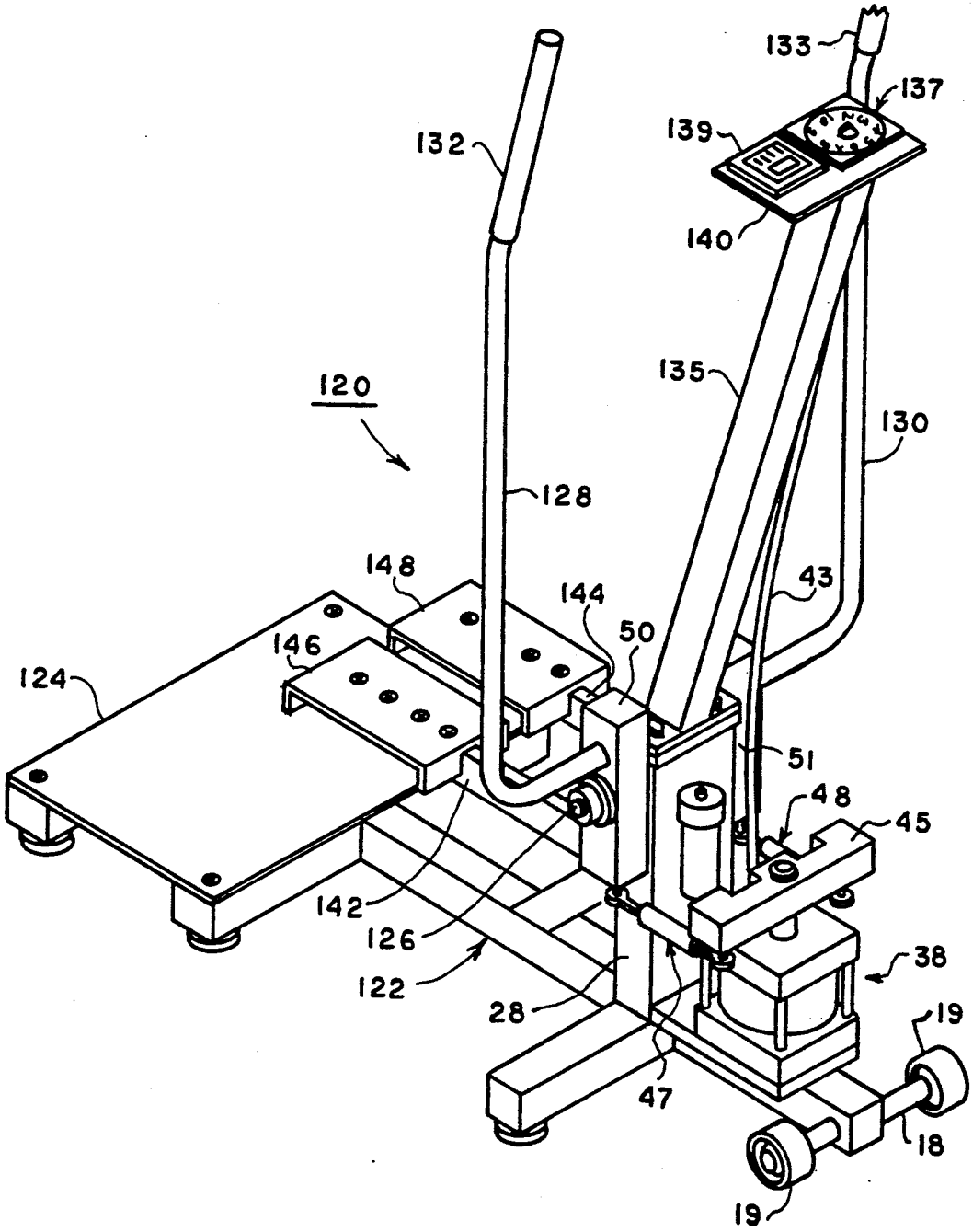
FIG. 5 is an isometric view of still another exercise machine embodying the present invention.

Referring to FIG. 5 there is shown still another exercise machine 120 embodying the present invention. The machine 120 is used to exercise the muscles used in cross country skiing. Like the machines 10 and 100 it incorporates a rotary hydraulic resistance device 38 which is mounted on a base frame 122 of the machine at the front and thereof. It includes a rearwardly disposed platform 124 on which the person using the machine stands. The machine is similar to the machine 10 and like parts are identified by the same reference numbers. The machine 120 thus includes a pair of pivot blocks 50 and 51 which are pivotable on a horizontal shaft 126 which is mounted to the vertical frame member 28. A pair of arms 128 and 130 are mounted to the tops of the blocks 50 and 51 and extend upwardly therefrom. A pair of handle grips 132 and 133 are respectively provided at the upper end portions of the arms 128 and 130. The arms 128 and 130 extend upwardly from the blocks 50 and 51 in a substantially vertical direction forwardly of the platform.

An upstanding frame member 135 is mounted to the top of the frame member 135 and extends forwardly at an angle of about 15 degrees. A torque resistance control knob 33 and associated dial plate 137 are carried by a support plate 140 which is affixed to the top of the frame member 135. A digital readout display 139 is also provided. The control knob 33 and the display 139 are located for convenient viewing and use by a person standing on the platform.

Extending from the bottoms of the blocks 50 and 51 below the shaft 126 are a pair of foot pad support arms 142 and 144 over the end portions of which are mounted two pedals 146 and 148. It will be seen that stepping on the pedal 146 causes the block to pivot in a counterclockwise direction as viewed in FIG. 5 and thus causes the crossarm 45 to also rotate counterclockwise as viewed from the top. At the same time the arm 128 pivots in in a clockwise direction as viewed in FIG. 5. The foot pad 148 and the arm 130 pivot simultaneously in a counterclockwise direction.

While the present invention has been described in connection with particular embodiments thereof, it will be understood by those skilled in the art that many changes may be made without departing from the true spirit and scope of the present invention. Therefore, it is intended by the appended claims to cover all such changes and modifications which come within the true spirit and scope of this invention.

What is claimed:

1. An exercise machine, comprising in combination a base adapted to rest on a floor, force resistance means mounted on said base, first and second pedals, pedal support arms connected to said pedals and mounted to said base for restricted pivotal movement of less than twenty degrees about a horizontal axis, means connecting said arms to one another, and means connecting said arms to said force resistance means to resist movement of said arms, said force resistance means comprising a hydraulic rotary torque resistance device having a housing mounted to said base and a shaft connected to said arms.

2. An exercise machine according to claim 1, comprising means for adjusting the torque resistance of said torque resistance device.

3. An exercise machine according to claim 2, comprising a crank arm connected to said shaft at a location intermediate the ends of said crank arm, first and second pivot members respectively connected to said pedal support arms and mounted to said base for pivotal movement about said horizontal axis, and first and second linkages respectively connected between said first and second pivot members and said crank arm on opposite sides of the location where the axis of rotation of said shaft intersects said crank arm.

4. An exercise machine according to claim 3, comprising first and second upstanding members connected at the lower end portions thereof to respective ones of said pivot members at locations above said horizontal axis, said pedal support arms being connected to said pivot members at locations below said horizontal axis.

* * * * *